US005372610A

United States Patent [19]

Kahle et al.

[11] Patent Number: 5,372,610

[45] Date of Patent: Dec. 13, 1994

[54] PROCESS FOR THE AFTER-BLEACHING OF DYED RAW CELLULOSE USING CATIONIC COMPOUNDS

[75] Inventors: Volker Kahle, Bergisch Gladbach; Klaus Kackstädter; Karl-Heinz Passon, both of Leverkusen; Martin Riegels, Hilden; Klaus Walz, Leverkusen, all of Germany

[73] Assignee: Bayer Aktiengesellschaft, Leverkusen, Germany

[21] Appl. No.: 940,117

[22] Filed: Sep. 3, 1992

[30] Foreign Application Priority Data

Sep. 13, 1991 [DE] Germany ..... 4130484

[51] Int. Cl.[5] ..... D06L 3/02

[52] U.S. Cl. ..... 8/111; 8/102

[58] Field of Search ..... 252/182.3, 186.29; 8/111, 102

[56] References Cited

U.S. PATENT DOCUMENTS

| | | | |
|---|---|---|---|
| 3,996,151 | 12/1976 | Kirner . | |
| 4,510,068 | 4/1985 | Rohlfs et al. | 252/186.29 |
| 4,515,596 | 5/1985 | Berendt et al. | 8/107 |
| 4,880,566 | 11/1989 | Baehr et al. . | |
| 4,959,075 | 9/1990 | Baehr et al. . | |
| 5,180,514 | 1/1993 | Farr et al. | 8/111 X |

FOREIGN PATENT DOCUMENTS

| | | |
|---|---|---|
| 0100300 | 7/1983 | European Pat. Off. . |
| 2301627 | 9/1976 | France . |
| 3545909 | 6/1987 | Germany . |
| 0472179 | 4/1972 | U.S.S.R. . |

*Primary Examiner*—Johann Richter
*Assistant Examiner*—Michael B. Hydorn
*Attorney, Agent, or Firm*—Sprung Horn Kramer & Woods

[57] ABSTRACT

Dyed raw cellulose can be bleached in a bleaching and after-treatment bath containing, in addition to usual stabilizers, cationic-monomeric and/or polymeric compounds and, if desired, nonionic surfactants. Bleaching is carried out with the aid of aqueous-hydrogen peroxide. The stabilizers that can be used and the cationic compounds are defined in the specification. Nonionic tensides, if their co-use is desired, are those of the class polyglycolethers.

4 Claims, No Drawings

PROCESS FOR THE AFTER-BLEACHING OF DYED RAW CELLULOSE USING CATIONIC COMPOUNDS

BACKGROUND OF THE INVENTION

1. FIELD OF THE INVENTION

The invention relates to a process for the bleaching of raw cellulose, preferably raw cotton, materials dyed with direct or reactive dyestuffs in a bleaching and after-treatment bath, characterised in that this bath contains a) stabilisers, b) cationic monomeric and/or polymeric compounds and, if desired, c) a non-ionic surfactant, and the bleaching auxiliaries comprising components a), b) and c).

Textile materials made of cellulose fibres are subjected, according to the prior technique, during pretreatment for dyeing, to a bleaching process, for example using hydrogen peroxide, in alkaline medium. This is followed by drying, dyeing and washing the bleached material.

The large number of steps in the pretreatment, such as, for example, boiling, washing, bleaching and drying, are time-consuming and cost-intensive steps in the textile industry. There have already been many attempts to carry out the processes described above in a simpler and less costly manner.

2. DESCRIPTION OF THE RELATED ART

EP 0,100,300 describes a process for the after-treatment of dyed, non-pre-bleached cellulose-containing fibre materials in a combined washing and bleaching bath. The treatment bath contains the following components:

a) derivatives of phosphonic or phosphorous acid as stabilisers and, if desired, b) polyhydroxy compounds.

It is already known (cf. SU 472,179) to dye and bleach cellulose textiles at the same time. The treatment liquor contains Cubosol dyestuffs, sodium nitrite, wetting agents and hydrogen peroxide stabilised with sodium metasilicate. Fixation of the dyestuff and bleaching take place simultaneously in a saturated steam atmosphere at 100° to 101° C. over a period of 3 to 10 minutes.

However, even these processes were not able to fully meet the demands in practice.

SUMMARY OF THE INVENTION

It has now been found that bleaching of cellulose materials dyed with direct or reactive dyestuffs can be carried out while achieving optimum properties in practical application by carrying out the treatment of such materials in a bleaching and after-treatment bath containing the following components:

a) stabilisers for the aqueous hydrogen peroxide bleaching liquors b ) cationic monomeric compounds and/or cationic polymers or polycondensation products and, if desired, c) non-ionic surfactants.

The invention furthermore relates to the bleaching auxiliaries mentioned comprising components a), b) and, if desired, c).

DETAILED DESCRIPTION OF THE INVENTION

The bleaching auxiliaries can contain a) 10–60% by weight of one or more stabilisers, b) 10–60% by weight of one or more cationic agents and c) 0 to 30% by weight of one or more non-ionic surfactants, preferably a) in an amount of 30–45% by weight, b) in an amount of 30–45% by weight and c) in an amount of 10–25% by weight.

The bleaching liquor stabilisers as such are known as prior art to one skilled in the art and described, for example, in Chwala/Anger "Handbuch der Textilhilfsmittel" (Handbook of Textile Auxiliaries), edition 1977, from page 340 onwards. Suitable bleaching liquor stabilisers are the following classes of compounds:

a1) phosphorus compounds, such as tripolyphosphates, orthophosphates, phosphonic acids, such as hydroxyethane-1,1-diphosphonic acid and phosphonoalkane-polycarboxylic acids, and 2-phosphonobutane-1,2,4-tricarboxylic acid (cf. DE 2,061,838, EP 0,100,300)

a2) magnesium salts of aminopolycarboxylic acids (German Auslegeschrift 1,113,931)

a3) ethylenediaminetetraacetic acid and salts thereof a4) polyacrylic acids and derivatives a5) gluconic acid a6) polyaminopolycarboxylic acid a7) polycarboxylic acid a8) (poly)aminomethylenephosphonic acids a9) sodium sulphamate (DE 3,342,175)

a10) aspartic acid a11) sulphosalicylic acid a12) polyhydroxamic acids a13) sodium silicate and magnesium silicate a14) phosphonic ester oligomers (EP 82,823).

In most cases, the stabilisers contain mixtures of the active compounds listed above, such as, for example:

gluconic acid and sodium pyrophosphate polyacrylamide, hexametaphosphate and orthophosphate sodium gluconate and sodium ethylenediaminetetraacetate ethylenediaminetetraacetic acid and hydroxyethane-1,1-diphosphonic acid gluconicacid, 2-phosphonobutane-1,2,4-tricarboxylic acid and ethylenediaminetetraacetic acid.

Suitable cationic agents are monomeric and polymeric compounds containing at least 1 cationic nitrogen; in particular quaternary compounds.

The group of cationic compounds includes, for example:

b1) alkylamine salts b2) quaternary ammonium salts b3) alkylpyridinium salts b4) protonated imidazole compounds or quaternary imidazolinium salts thereof b5) alkyldiamines and alkylpolyamines and quaternisation products thereof b6) acyldiamines and acylpolyamines and quaternisation products thereof b7) methyleneoxyalkylpyridinium salts and b8) alkylethyleneureas.

Compounds of this type are sufficiently well-known in the art. Some of them are used as levelling agents for the dyeing of anionic polyacrylonitrile fibres (cf. R. Rohkohl, Tenside 2 (1965) 76).

Further suitable compounds of group b) are b9) cationic polymers and polycondensation products, such as often used in the paper and textile industry, for example described in:

Aftertreatments for improving the fastness of dyes on textile fibers, C. C. Cook, Rev. Prog. Coloration 12 (1982) 73 and H. Fischer: Textilveredlung 25 (1990), pages 54 to 61.

Some examples of the cationic monomeric and polymeric compounds according to the invention are described below:

cationic monomeric compounds of the following formula

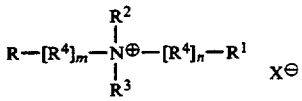

(I)

where

R and $R^1$ are $C_1$–$C_{20}$-alkyl, $C_3$–$C_{20}$-alkenyl, cycloalkyl, aralkyl, $R^2$ and $R^3$ are $C_1$–$C_4$-alkyl, $C_1$–$C_4$-hydroxyalkyl or both radicals, together with N, form a heterocyclic ring, $R^4$ is —CO—NH—alkylene ($C_2$–$C_3$) —COO—alkylene ($C_2$–$C_3$) —CH(OH)—$CH_2$——O—alkylene ($C_2$–$C_3$) —O—$CH_2$—CH(OH)—$CH_2$— where m+n is 0 or 1

$X^\ominus$ is an anion, the cationic polymers are described by the following formulae:

structural units

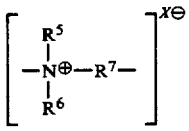

(II)

where $R^5$ is H, $C_1$–$C_4$-alkyl, $C_1$–$C_4$-hydroxyalkyl $R^6$ is $R^5$ cyclohexyl, benzyl $R^7$ is $C_2$–$C_{12}$-alkylene, which may be interrupted by one or more

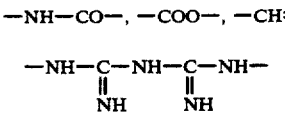

or structural units

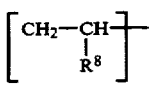

(III)

where $R^8$ is

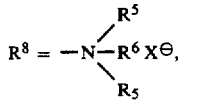

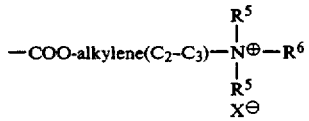

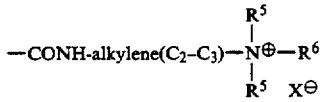

or polydiallyldimethylammonium chloride dicyandiamide/formaldehyde/ammoniumchloride condensation products.

The non-ionic surfactants used are polyglycol ethers, for example EO/PO copolymers, sugar polyethers and alkoxylation products, in particular ethoxylation products of fatty alcohols, fatty amines, phenol-styrene adducts, alkylphenols, fatty acids and fatty amides. The surfactants contain 4 to 100 alkenoxy groups, in particular 12 to 60 ethyleneoxy groups.

The ratio of components a):b):c) is 1:0.5–3.0:0.00–1.0, in particular 1:0.7–2.5:0.1–0.8.

Cellulose-containing fibre materials can be dyed by the process according to the invention without pretreatment and then bleached in alkaline medium.

The process according to the invention prevents bleeding of the dyestuff into the bleaching bath to the greatest possible extent and thus makes it possible to use the liquor repeatedly for differently dyed fibre materials.

If dyed raw cotton is subjected to a standard bleaching process, bleeding of dyestuffs into the bleaching liquor necessarily leads to a loss in colour depth. The new process makes it possible to use smaller amounts of dyestuff, since the components according to the invention virtually prevent bleeding of the dyestuffs during the after-bleaching process. The cellulose-containing fibre materials used are dyed in the customary liquors using direct or reactive dyestuffs, such as known in practice.

Preferably, this process can be carried out, for economic reasons, as a wet-on-wet process.

The advantages of this process compared with conventional ones are as follows:

Depending on the reactive dyestuffs and processes used, a yield which is higher by up to 80% and higher brilliance of the dyeings are obtained. Staining of the bleaching liquors is also substantially reduced. This enables, for example, different shades to be after-bleached in the same bleaching liquor. In this way, the economy of the underliquor bleach systems is substantially increased.

The after-bleaching process of raw cotton dyed with reactive or direct dyestuffs is carried out in the usual manner.

The amounts used of the mixtures mentioned vary within wide limits and depend, inter alia, on the process, the bleaching level to be achieved, etc.

A rough classification can be made as follows:

batchwise processes (liquor ratio 2:1–40:1) 0.2–3.5 g/l (total active compound of the compounds according to the invention)

continuous processes 0.8–20.0 g/l

In addition to the bleaching auxiliaries according to the invention containing the components mentioned, a bleaching liquor in general contains the following substances known to one skilled in the art:

$MgSO_4.7H_2O$ non-ionic detergent, for example a reaction product of dodecyl alcohol with 4 mol of ethylene oxide NaOH $H_2O_2$ and, if desired, with the addition of $SiO_2$. $Na_2O$.

The process parameters for the bleaching process are in general as follows:

pH value: 7.0–14, preferably 11.0–13.0 temperature: 25°–98° C., preferably 80°–98° C.

time 5–180 min liquor ratio: 1:1–40:1

Areas of application:

bleaching from long liquor, pad-steam bleaching, cold pad-batch bleaching, pad-roll bleaching, preferably underliquor bleach.

EXAMPLES

Bleaching auxiliary: Mixture A

A mixture comprising 18 parts of 2-phosphonobutane-1,2,4-tricarboxylic acid 4 parts of diethylenetriamine pentamethylenephosphonic acid and 11 parts of $C_{18}$-fatty alcohol reacted with about 50 ethylene oxide is stirred until homogeneous with heating to 50 to 60° C. and then 18 parts of $C_{12}$-alkyldimethylbenzylammonium chloride are added with further stirring.

The mixture contains the organic acids as sodium salts and 49 parts of water.

Bleaching auxiliary: Mixture B

In accordance with the procedure for preparing mixture A, the following components are stirred until homogeneous:

14 parts of 2-phosphonobutane-1,2,4-tricarboxylic acid 3 parts of diethylenetriaminepentamethylenephosphonic acid 7 parts of $C_8$-fatty alcohol reacted with about 50 ethylene oxide and 15 parts of a polycondensation product containing recurring units of the formula D

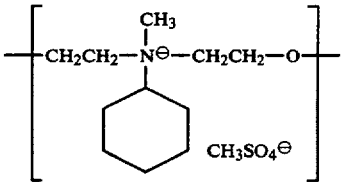

61 parts of water. The organic acids are present as sodium salts.

Example 1

A circular-knitted fabric made of 100% raw cotton is dyed with 3 g/l of C. I. Reactive Orange 67

12 g/l of C. I. Reactive Red 158 by the pad-steam method. It is then rinsed at 60° C. and squeezed off to a residual moisture of 70%. In an underliquor bleach ranger the fabric is padded wet-on-wet with a bleaching liquor at 25° C. comprising 0.2 g/l of $MgSO_4$. $7H_2O$ 8.0 ml/l of mixture A 1.0 ml/l of a reaction product of decyl alcohol with 5 ethylene oxide and 4 propylene oxide 1.8 ml/l of 100% NaOH 5.0 ml/l of 50% $H_2O_2$ at a liquor pick-up of 80%. The fabric thus impregnated is passed through 2 peroxide reactors over a period of 4 minutes and is heated to 85° C. by spraying using the abovementioned bleaching liquor. The fabric then remains in the J box in the bleaching liquor at a liquor-to-fabric ratio of 3:1 for 25 minutes. It is rinsed at 90° C. for 15 minutes and at 40° C. for 5 minutes. Finally, the fabric is dried.

Compared with conventional processes, a dyestuff yield which is 40% higher is obtained.

Instead of $C_{12}$-alkyldimethylbenzylammonium chloride in mixture A, the same amounts of the following compounds can be used equally successfully:

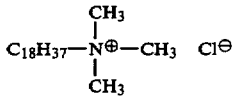

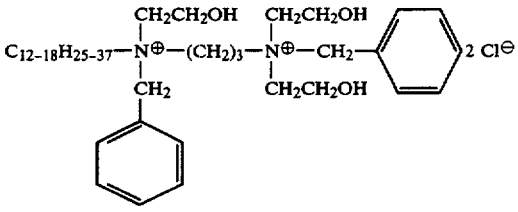

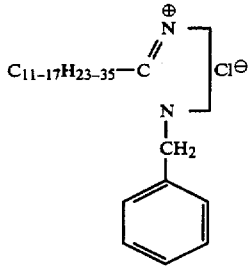

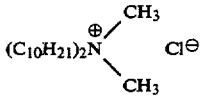

Example 2

Bleaching from long liquor (batchwise)

A piece of knitwear made of 100% raw cotton is dyed in an overflow dyeing apparatus with 0.25% of C. I. Reactive Yellow 111

0.80% of C. I. Reactive Green 21

0.50% of C. I. Reactive Blue 116.

It is then subjected to hot rinsing at 60° C. for 10 minutes. Bleaching is started at 60° C. by adding 0.5 ml/l of the reaction product of decyl alcohol with 5 ethylene oxide and 4 propylene oxide 2.0 ml/l of mixture B 1.2 g/l of 100% NaOH 3.0 ml/l of 50% strength $H_2O_2$.

The liquor is heated to 90° C. at a gradient of 2° C./min. At this temperature, the piece is treated for 30 minutes. The liquor is dropped and the piece is soaped at the boil for 10 minutes with addition of 0.5 ml/ of a 50% strength solution of 2-phosphonobutane-1,2,4-tricarboxylic acid and 0.5 ml/l of an anionic detergent. Finally, it is rinsed hot and cold.

Bleaching carried out by this process is distinguished by a colour depth which is 30% higher than in bleaching without the auxiliaries according to the invention.

Instead of the polycondensation product used in mixture B, products having recurring units of the following formulae

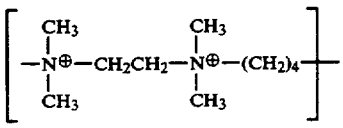

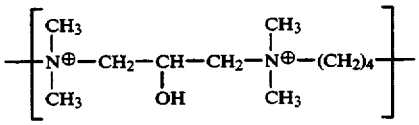

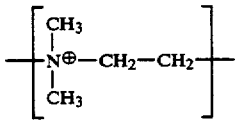

or a product prepared by polycondensation of dicyandiamide, formaldehyde and ammonium chloride can also be used equally successfully.

What is claimed is:

1. In a process for the bleaching of cellulose materials dyed with direct or reactive dyestuffs, whereby bleaching is carried out with aqueous hydrogen peroxide bleaching liquors comprising the steps of (i) dyeing the raw cellulose, (ii) treating the dyed-raw cellulose in a combined washing and bleaching bath, and (iii) drying, the improvement which comprises carrying out said treating and bleaching steps in a bleaching and after-treatment bath containing the following components:

a) stabilisers for the aqueous hydrogen peroxide bleaching liquors, b) one or more members selected from the group consisting of cationic monomeric compounds, cationic polymers and polycondensation products, and, if desired, c) polyglycolether surfactants.

2. The process of claim 1, wherein said stabilizers comprise one or more compound(s) from the following classes of compounds:

a1) tripolyphosphates, orthophosphates, phosphonic acids, phosphonoalkane-polycarboxylic acids;

a2) magnesium salts of aminopolycarboxylic acids;

a3) ethylenediaminetetraacetic acid and salts thereof;

a4) polyacrylic acids and derivatives;

a5) gluconic acid;

a6) polyaminopolycarboxylic acid;

a7) polycarboxylic acid;

a8) (poly)aminomethylenephosphonic acids;

a9) sodium sulphamate;

a10) aspartic acid;

a11) sulphosalicylic acid;

a12) polyhydroxamic acids;

a13) sodium silicate and magnesium silicate; and a14) phosphonic ester oligomers.

3. The process of claim 1, wherein said one or more members selected from the group consisting of cationic monomer compounds, cationic polymers, and polycondensation compounds are one or more compound(s) from the following classes of compounds:

b1) alkylamine salts;

b2) quaternary ammonium salts;

b3) alkylpyridinium salts;

b4) protonated imidazole compounds or quaternised imidazolimiun salts thereof;

b5) alkyldiamines and alkylpolyamines and quaternisation products thereof;

b6) acyldiamines and acylpolyamines and quaternisation products thereof;

b7) methyleneoxyalkylpyridinium salts;

b8) alkylethyleneureas; and b9) cationic polymers and polycondensation products.

4. The process of claim 1, wherein the ratio of a):b):c) is a weight ratio of 1:0.7–2.5:0.1–0.8.

* * * * *